US005562464A

United States Patent [19]

Lecourtois

[11] Patent Number: 5,562,464

[45] Date of Patent: Oct. 8, 1996

[54] COAXIAL TYPE CONNECTOR-SWITCH COMPONENT FOR HIGH FREQUENCIES

[75] Inventor: Eugène Lecourtois, Echarcon, France

[73] Assignee: Nicomatic, Bons-En-Chablais, France

[21] Appl. No.: 481,522

[22] PCT Filed: Nov. 7, 1994

[86] PCT No.: PCT/FR94/01288

§ 371 Date: Jul. 7, 1995

§ 102(e) Date: Jul. 7, 1995

[87] PCT Pub. No.: WO95/13637

PCT Pub. Date: May 18, 1995

[30] Foreign Application Priority Data

Nov. 8, 1993 [FR] France ..... 93 13256

[51] Int. Cl.[6] ..... H01R 29/00

[52] U.S. Cl. ..... 439/188; 343/702; 343/906; 200/51.05; 200/51.1; 200/51.09

[58] Field of Search ..... 439/188, 610, 439/217; 343/702, 906; 200/51.05, 51.1, 51.09

[56] References Cited

U.S. PATENT DOCUMENTS

| | | | |
|---|---|---|---|
| 3,946,390 | 3/1976 | Alexander et al. | 343/702 |
| 4,286,335 | 8/1981 | Eichler et al. | 455/89 |
| 5,174,775 | 12/1992 | Birch | 439/188 |

*Primary Examiner*—P. Austin Bradley
*Assistant Examiner*—Christopher Ryan Goins
*Attorney, Agent, or Firm*—Larson and Taylor

[57] ABSTRACT

The invention relates to a coaxial type connector-switch component for high frequencies. The component comprises a conductor body (10), a first contact (16), a second contact (28), and a moving assembly (34) which is movable in translation along an axis between a first position and a second position. The moving assembly comprises a conductive member (36) that is slidably mounted on the first contact (16) and that possesses a moving contact (40) which cooperates with the second contact (28) when the moving assembly (34) is in the first position, and which is remote from the second contact (28) when the moving assembly (34) is in its second position. A return device (54) urges the moving assembly (34) towards its firs position. The invention is applicable to car radiotelephones.

9 Claims, 1 Drawing Sheet

COAXIAL TYPE CONNECTOR-SWITCH COMPONENT FOR HIGH FREQUENCIES

The invention relates to the field of coaxial type components for use at high frequencies. More precisely, it relates to a miniature component that forms both a connector and a switch.

More and more portable type appliances are being used that operate at high frequencies. The most common are car radiotelephones which can be used either in a car, in which case the appliance is connected to an antenna of the car, or else outside it as a portable telephone, using an antenna incorporated in the appliance. It is therefore necessary for the appliance both to include a connector enabling it to be connected to an external car antenna, and also to possess a switch for switching between the two antennas.

The present invention relates to a connector-switch component designed to enable the above-mentioned switching to be performed automatically when the appliance is connected to and disconnected from an external antenna. More precisely, when the appliance is used as a portable appliance outside a car, the circuit of the appliance is connected to the external antenna via an internal contact. When the appliance is put into place in a car, it is placed in a connector incorporated in the car and connected to an external antenna, and the connector displaces a moving assembly which serves firstly to provide a connection between the external antenna and the internal circuit of the appliance, and secondly to disconnect and ground the second contact which is connected to the internal antenna of the appliance. Such grounding is particularly advantageous at high frequencies (particularly above 1 GHz) since otherwise the disconnected member can give rise to interference that spoils operation.

More precisely, the invention provides a coaxial type connector-switch component for high frequencies, comprising: a conductive body defining an elongate cavity and designed to be connected to ground; a first contact supported by a first insulating member at a first end of the elongate cavity in the body so as to be fixed relative to the body; a second contact supported by a second insulating member in a wall of the body so as to be accessible on one side of the elongate cavity and so as to be fixed relative to the body; an assembly that is movable in translation along an axis between a first position and a second position and comprising: a conductive member co-operating by sliding with the first contact with which it is in permanent contact, and possessing a moving contact which co-operates with the second contact when the moving assembly is in the first position and which is remote from the second contact when the moving assembly is in its second position; a ground conductive member electrically connected to the body and disposed around the insulating member of the moving assembly to which it is secured so that, in the first position of the moving assembly, it is remote from the second contact, and in the second position of the moving assembly, it co-operates with the second contact; and a third insulating member disposed around the conductive member and insulating it relative to the body; and a return device for returning the moving assembly towards its first position.

In one embodiment, the moving contact projects laterally from the conductive member of the moving assembly, and the connector-switch component further includes a guide device for providing guidance in translation and that is designed to prevent rotation of the moving assembly about its displacement axis. Preferably, the guide device comprises a cylindrical sector formed by the third insulating member and a complementary cylindrical sector formed by the first insulating member, the two cylindrical sectors co-operating via surfaces parallel to the displacement axis.

Preferably, the body of the component further includes an impedance-matching cavity formed inside the body around the moving contact.

Preferably, the ground conductor member is a conductive sleeve having a cylindrical body extended by two diametrically opposite arms, one of the arms being designed to co-operate with the second contact, and the other arm being designed to guide the sleeve during displacement of the moving assembly by co-operating with a groove in the first insulating member, so that the moving assembly cannot rotate about its displacement axis while it is being displaced in translation.

Advantageously, the first contact includes a pin disposed on the translation displacement axis of the moving assembly.

Advantageously, the return device comprises a helical spring disposed between an inside shoulder of the body and an outside shoulder of the moving assembly. Preferably, the outside shoulder of the moving assembly is a shoulder of the ground conductor member.

Also, the conductor member of the moving assembly includes, at its end remote from that which includes the moving contact, a fourth contact member forming, with the body, a portion of the connector that is designed to co-operate with a complementary portion of an external connector.

Other features and advantages of the invention appear more clearly from the following description, given with reference to the accompanying drawing, in which.

Figure 5:
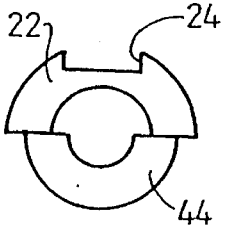
FIG. 5 is a diagrammatic section view of the two insulating members of the component of FIGS. 1 and 2.
Figure 1:
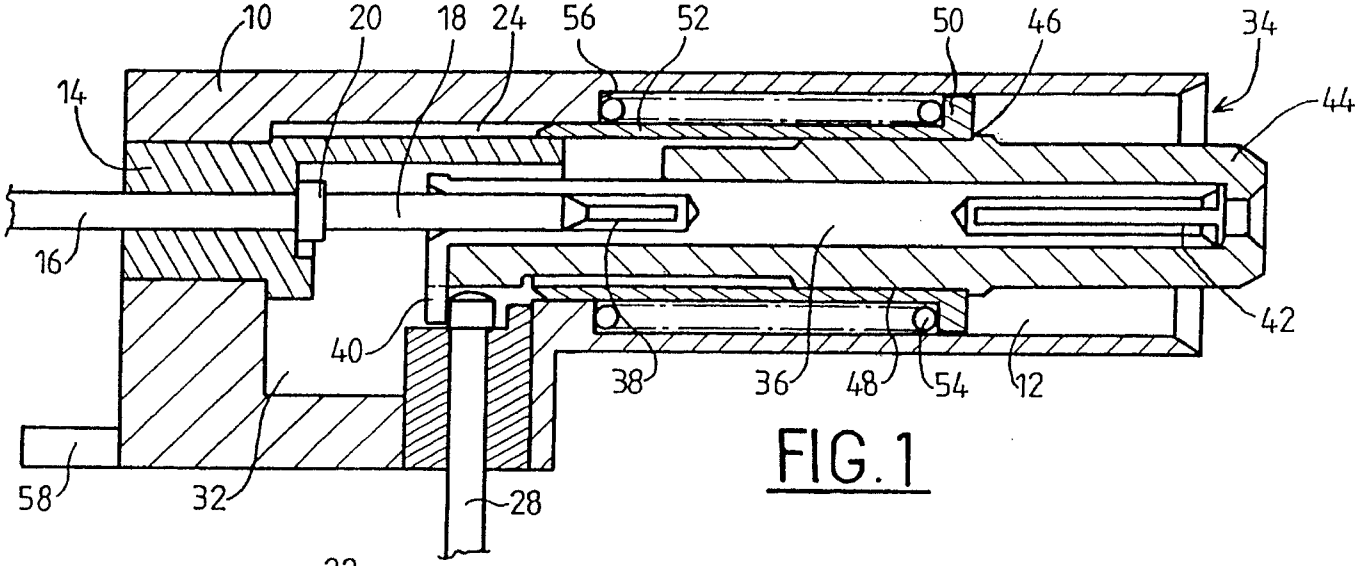
FIG. 1 is a longitudinal section through a connector-switch component of the invention, shown in a first position in which it enables the appliance in which it is incorporated to operate with an internal antenna.
Figure 2:
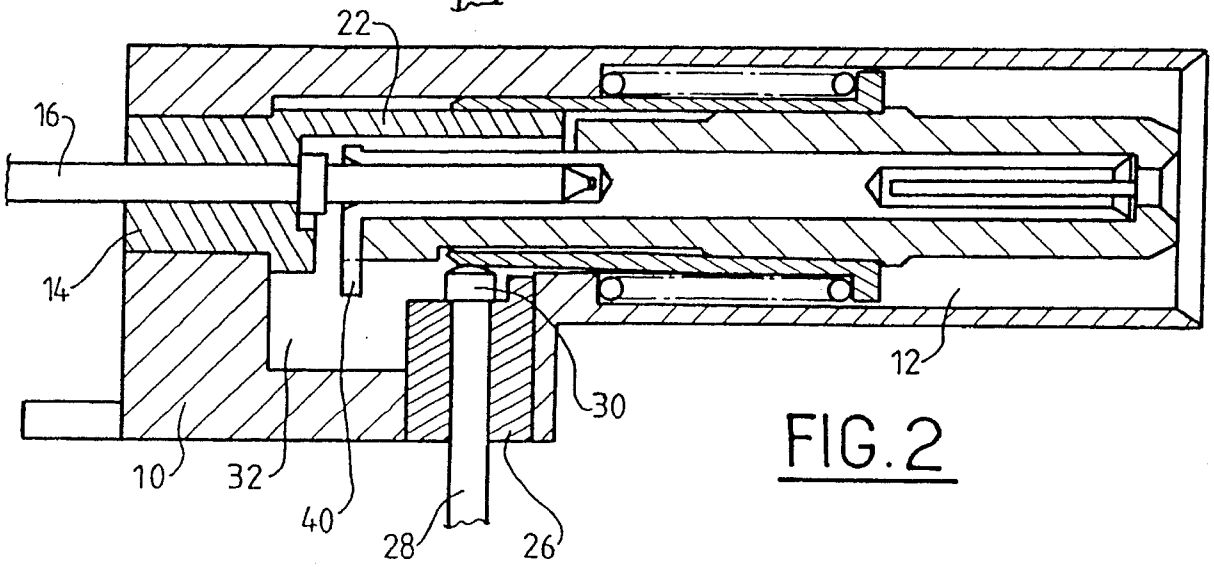
FIG. 2 is a section through the connector-switch component of the invention, in a second position in which it enables the appliance to operate with an external antenna.

The connector-switch component shown in FIGS. 1 and 2 comprises a conductive body 10 which is advantageously made of metal. It defines an internal longitudinal cavity 12 which comprises, in succession from the outer portion shown to the right in FIGS. 1 and 2: a first cylindrical portion; and a second cylindrical portion opening out into an enlarged portion 32 described below. The internal end (to the left in FIGS. 1 and 2) has a cylindrical hole which is closed by a first insulating member 14 which carries a first fixed contact 16. The contact 16 includes, in alignment therewith, a pin 18 positioned by a collar 20 against the insulation 14. The insulation 14 has a cylindrical portion placed in the cylindrical hole at the end of the body 10, and a portion 22 placed inside the cavity of the body 10 and that is semicylindrical in shape, as shown in FIG. 5. This portion is extended approximately to the end of the pin 18. On its outside face, it has a groove 24 that is used for a purpose described below.

The body 10 also has a lateral hole in which a second insulator 26 is received which supports a second fixed contact 28. This contact is terminated by a rounded head 30 that projects a little into the cavity of the body, through a side thereof. Close to the second contact 28, and more precisely to its head 30 placed inside the body, the body has an enlarged cavity 22 whose function is described below.

The elements described above are fixed relative to one another and they are intended to be fixed to the body of an appliance. The component also includes a moving assembly 34.

The moving assembly comprises a conductor member 36 that is analogous to an elongate rod. At its end facing the first contact 16, the conductive member 36 has a longitudinal hole 38 fitted onto the pin 18 of the first contact. A slot is shown formed through said hole so as to enable the pin 18 to be lightly clamped by the conductive member 36 while still being capable of sliding in the hole 38. At the end of the conductive member which faces the pin 18, the member includes a tab 40 which constitutes a moving contact. In the disposition shown in FIG. 1, it will be seen that said moving contact 40 is placed against the head 30 of the second fixed contact 28. In contrast, in the position of FIG. 2, the contact 40 is remote from the contact head 30 and is to be found in the middle of the cavity 32 which thus is capable of performing to the full its function of impedance matching.

The other end of the conductive member 36 of the moving assembly 34 has an element enabling it to make connection with an external connector member. In the embodiment shown in FIGS. 1 and 2, this connection element is constituted by a hole 32 analogous to the hole 38 and designed to co-operate with a pin. However, that is merely a simple example implemented in the form of a female element, and other female or male elements could be used to replace it.

Figure 3:
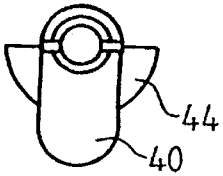
FIG. 3 is an end view of the moving assembly of the component of FIGS. 1 and 2.

The connector member 36 of the moving assembly is surrounded by a third insulating member 44. This member is in the form of a circularly symmetrical cylinder. However, in its portion facing the first fixed contact 16, it is cut away so as to have a semicylindrical shape as indicated by reference 44 in FIGS. 3 and 5. The insulating member 44 surrounds the member 36 over substantially all of its length with the exception of a portion that is left disengaged for the purpose of receiving the semicylindrical portion 22 of the first insulating member 14.

Figure 4:
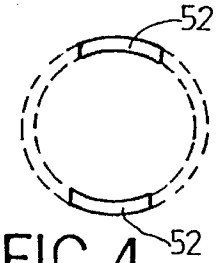
FIG. 4 is a section view of a sleeve of the component of FIGS. 1 and 2, a section being through the arms of the sleeve.

The moving assembly also includes a ground conductor member represented by a sleeve 48 that is cylindrical in shape. At its outer end, the sleeve 48 carries a collar 50 and its cylindrical body is extended towards the first contact 16 by arms 52 that are shown more clearly in FIG. 4.

Finally, a spring 54 constitutes a return member for the purpose of urging the moving assembly 34 outwardly from the body 10. To this end, the spring 54 bears at one end against the collar 50 of the ground conductor sleeve, and at its other end against a shoulder 56 of the body.

The operation of the connector-switch component of FIGS. 1 and 2 is now described in its application to a portable type car radiotelephone.

When the component is mounted in a portable car radiotelephone, the body 10 is fixed in the housing of the radiotelephone and, since it is conductive, it is grounded by a tab 58. The first contact 16 is connected to the electronic circuits of the appliance. The second fixed contact 28 is connected to the internal antenna of the radiotelephone. So long as the radiotelephone is not installed in a car, the component takes up the position shown in FIG. 1. More precisely, the spring 54 acts against the sleeve 48 and consequently urges the moving assembly 34 into the position shown in FIG. 1 where the resilient and conductive fingers of the sleeve 52 are remote from the head 30 of the second fixed contact. In contrast, the tab constituting the moving contact 40 of the conductive member 36 is placed against the head 30 of the second fixed contact 28. Since the conductive member 36 is also permanently connected to the first fixed contact 16 by sliding of the hole 38 on the pin 18, the two fixed contacts 16 and 28 are connected together. Consequently, the internal antenna of the radiotelephone is connected to the electronic circuits thereof. The radiotelephone can thus be used as a portable telephone.

When the radiotelephone is to be used inside a car, it is received in a cavity provided for this purpose. The body of the radiotelephone is then guided in such a manner that the component of FIG. 1 comes into co-operation with a complementary connector member which, in the case of the particular component shown in FIGS. 1 and 2, includes a pin surrounded by a grounding cup. When the radiotelephone is installed, this pin penetrates into the hole 42 and then pushes back the moving member 34, while the end of the body 10 is received in the cup of the complementary connector. The moving assembly thus moves into the position shown in FIG. 2. In this position, the spring 54 has been compressed by displacement of the collar 50 to the left in FIG. 2. Consequently, the moving contact 40 is moved away from the contact head 30. The first fixed contact 16 is therefore no longer connected to the second fixed contact 28. However, it is connected to the pin which has been inserted into the hole 42, and it is therefore connected to the external antenna. In addition, displacement of the moving member 34 causes a conductive finger 58 on the contact head 30 to pass through, whereas the other conductive finger 52 provides rotary positioning of the sleeve 48 by sliding in the groove 24 of the first insulating member 14. Consequently, the second fixed contact 28 is then in contact with the sleeve 48 which is itself grounded by contact with the body, in particular via the spring 54 and the resilient guide finger 52. The cavity 32 provides impedance matching so that operation with the external antenna is not disturbed and, simultaneously, the internal antenna is connected to ground and does not disturb the call.

In one embodiment, the body 10 is made of an aluminum-based light alloy and the fixed contacts 16 and 28, the conductive member 36, and the sleeve 48 are made of bronze or of beryllium. The spring 54 is made of steel. The insulators 14, 26, and 44 are advantageously made of "Nylon".

In one embodiment, the total width of the component of FIGS. 1 and 2 is 4 mm, its length is 11 mm, and the stroke of the moving member 34 is 0.9 mm. The component is thus a miniature component which nevertheless performs functions that are complex. It enables switching between a first position in which the first two contacts are connected together and a second position in which one of the fixed contacts is connected to an external contact while the other fixed contact is grounded. It therefore performs simultaneously the functions of a connector, a changeover switch, and an on/off switch.

It is mentioned that the moving assembly is guided in translation in such a manner as to prevent it from rotating because of co-operation between a semicylindrical portion 22 of the first insulating member 14 and a semicylindrical portion of the insulator 44 of the moving assembly 34. Naturally, numerous other guide devices could be used. Although in this embodiment guidance is provided between two insulators, it may also be provided between an insulator and the moving conductive member 36, or between the moving conductive member and the first contact. In addition, although it is specified that guidance of the sleeve 48 is provided by displacement of a finger 52 in a groove 24 of the insulator, other dispositions are possible, e.g. a stud secured to the sleeve 48 could slide in a groove of the body 10.

It is mentioned that the fixed member 16 includes a pin that co-operates with a female element represented by the hole 38 in the conductive member 36. Any other disposition could be used providing it maintains co-operation between the fixed contact 16 and the conductor member 36. In particular, the male-female disposition could be replaced by a female-male disposition.

Although it is specified that the return member is constituted by a helical spring placed between the body and the conductive sleeve 48, numerous other return devices could also be used, in particular devices that do not work in compression, but that work in traction.

Finally, although it has been specified that the portion of the conductor formed at the righthand end (in FIGS. 1 and 2) of the component is of the female type, other types of conductive element could be used. All that is required is that the conductive portion formed by the component is suitable for co-operating with a complementary portion by displacement in the longitudinal direction of the component, i.e. in the displacement direction of the moving assembly 34.

I claim:

1. A coaxial type connector-switch component for high frequencies, characterized in that it comprises:

a conductive body (10) defining an elongate cavity (12) and designed to be connected to ground;

a first contact (16) supported by a first insulating member (14) at a first end of the elongate cavity in the body (10) so as to be fixed relative to the body;

a second contact (28) supported by a second insulating member (26) in a wall of the body (10) so as to be accessible on one side of the elongate cavity and so as to be fixed relative to the body;

an assembly (34) that is movable in translation along an axis between a first position and a second position and comprising:

a conductive member (36) co-operating by sliding with the first contact (16) with which it is in permanent contact, and possessing a moving contact (40) which co-operates with the second contact (28) when the moving assembly (34) is in the first position and which is remote from the second contact (28) when the moving assembly (34) is in its second position;

a ground conductive member (48) electrically connected to the body (10) and disposed around the insulating member (44) of the moving assembly (34) to which it is secured so that, in the first position of the moving assembly, it is remote from the second contact (28), and in the second position of the moving assembly, it co-operates with the second contact (28); and a third insulating member (44) disposed around the conductive member (36) and insulating it relative to the body; and a return device (54) for returning the moving assembly (34) towards its first position.

2. A connector-switch component according to claim 1, characterized in that it further includes an impedance-matching cavity (32) formed inside the body (10) around the moving contact (40).

3. A connector-switch component according to claim 1, characterized in that the ground conductor member is a conductive sleeve (48) having a cylindrical body extended by two diametrically opposite arms (52), one of the arms being designed to co-operate with the second contact (28), and the other arm being designed to guide the sleeve (48) during displacement of the moving assembly (34) by co-operating with a groove (24) in the first insulating member (14), so that the moving assembly (34) cannot rotate about its displacement axis while it is being displaced in translation.

4. A connector-switch component according to claim 1, characterized in that the first contact (16) includes a pin (18) disposed on the translation displacement axis of the moving assembly (34).

5. A connector-switch component according to claim 1, characterized in that the conductor member (36) of the moving assembly (34) includes, at its end remote from that which includes the moving contact (40), a fourth contact member (42) forming, with the body (10), a portion of the connector that is designed to co-operate with a complementary portion of an external connector.

6. A connector-switch component according to claim 1, characterized in that the moving contact (40) projects laterally from the conductive member (36) of the moving assembly (34), and the connector-switch component further includes a guide device (22, 44) for providing guidance in translation and that is designed to prevent rotation of the moving assembly (34) about its displacement axis.

7. A connector-switch component according to claim 6, characterized in that the guide device (22, 44) comprises a cylindrical sector formed by the third insulating member (44) and a complementary cylindrical sector (22) formed by the first insulating member (14), the two cylindrical sectors co-operating via surfaces parallel to the displacement axis of the moving assembly (34).

8. A connector-switch component according to claim 1, characterized in that the return device comprises a helical spring (54) disposed between an inside shoulder (56) of the body (10) and an outside shoulder of the moving assembly (34).

9. A connector-switch component according to claim 8, characterized in that the outside shoulder of the moving assembly is a shoulder of the ground conductor member (48).

* * * * *